US007458523B2

(12) United States Patent
Hyslop

(10) Patent No.: US 7,458,523 B2
(45) Date of Patent: Dec. 2, 2008

(54) FOAM-DISPENSING FAUCET

(76) Inventor: William J. Hyslop, 105 Jefferson Valley, Coatesville, IN (US) 46121

( * ) Notice: Subject to any disclaimer, the term of this patent is extended or adjusted under 35 U.S.C. 154(b) by 0 days.

(21) Appl. No.: 11/717,549

(22) Filed: Mar. 13, 2007

(65) Prior Publication Data

US 2007/0152082 A1 Jul. 5, 2007

Related U.S. Application Data

(60) Provisional application No. 60/875,241, filed on Dec. 14, 2006.

(51) Int. Cl.
*A01G 27/00* (2006.01)

(52) U.S. Cl. ..... 239/67; 239/70; 239/312; 239/311; 239/407; 239/419; 4/567; 4/597; 4/615; 4/616; 222/334; 222/372; 137/624.14

(58) Field of Classification Search ..... 239/67, 239/70, 289, 311, 312, 407, 419, 432, 436, 239/443; 4/623, 628, 903; 137/624.14; 222/334, 222/372

See application file for complete search history.

(56) References Cited

U.S. PATENT DOCUMENTS

| | | | | |
|---|---|---|---|---|
| 1,705,608 | A | 3/1929 | Erwin et al. | |
| 2,715,045 | A | 8/1955 | Thompson | |
| 4,277,030 | A | 7/1981 | Hechler, IV | |
| 4,345,621 | A * | 8/1982 | Dunckhorst | 137/624.12 |
| 4,802,630 | A | 2/1989 | Kromrey et al. | |
| 5,171,090 | A | 12/1992 | Wiemers | |
| 5,230,368 | A * | 7/1993 | Berfield | 137/889 |
| 5,402,812 | A * | 4/1995 | Moineau et al. | 137/1 |
| 5,540,362 | A * | 7/1996 | Azuma et al. | 222/642 |
| 5,613,773 | A | 3/1997 | Scott et al. | |
| 5,781,942 | A * | 7/1998 | Allen et al. | 4/623 |
| 5,857,594 | A | 1/1999 | Ozturk | |
| 5,868,311 | A | 2/1999 | Cretu-Petra | |
| 6,095,370 | A | 8/2000 | Rhine et al. | |
| 6,206,241 | B1 | 3/2001 | Terrell et al. | |
| 6,357,532 | B1 | 3/2002 | Laskaris et al. | |
| 6,371,384 | B1 | 4/2002 | Garcia | |
| 6,456,903 | B1 | 9/2002 | Rosenbaum et al. | |
| 7,069,941 | B2 * | 7/2006 | Parsons et al. | 137/1 |
| 2002/0033424 | A1 | 3/2002 | Rivera et al. | |

* cited by examiner

*Primary Examiner*—Dinh Q Nguyen
(74) *Attorney, Agent, or Firm*—Woodard, Emhardt, Moriarty, McNett & Henry LLP

(57) ABSTRACT

A foam-dispensing faucet for dispensing a quantity of foam soap and separately dispensing a flow of water according to one embodiment of the present invention includes a faucet body having a dispensing opening, water supply means integrated into the faucet body for delivering water to the foam-dispensing faucet, liquid soap means integrated into the faucet body for delivering liquid soap to the foam-dispensing faucet, air supply means integrated into the faucet body for delivering air to the foam-dispensing faucet, the interior of the faucet body being configured for processing liquid soap from the liquid soap means and air from the air supply means into a foam soap, and control means for timing and sequencing the dispensing of water and foam soap from the foam-dispensing faucet.

7 Claims, 6 Drawing Sheets

FOAM-DISPENSING FAUCET

CROSS REFERENCES TO RELATED APPLICATIONS

The present application claims the benefit of, and is a Continuation-in-Part patent application of, U.S. Provisional Patent Application Ser. No. 60/875,241, filed Dec. 14, 2006, entitled "FOAM-DISPENSING FAUCET" which is hereby incorporated by reference in its entirety.

BACKGROUND OF THE INVENTION

The present invention relates in general to water dispensing faucets of the type commonly found in school lavatories, public restrooms, hotel restrooms, office building lavatories, industrial facilities, and homes. More specifically, the present invention relates to soap dispensers that are used in the types of locations described above. It is understandable that when the faucet is intended to deliver water for washing one's hands, a supply of soap should be nearby. When the faucet is in a public location or facility, the soap is usually contained in a sink-mounted or wall-mounted dispenser. Such dispensers are intended to provide some degree of control over the soap usage, compared to bars of soap, and some degree of sanitation considering the multiple users. Nevertheless, there is waste, mess, and inefficiency associated with these types of conventional public soap dispensers.

While these types of soap dispensers may have benefits compared to bars of soap, these dispensers can and often do create a mess on the sink and/or on the floor beneath the dispenser. This mess comes from soap that is dispensed, but not into the hand of the user. This is also wasteful, creating an increased cost. Push button or plunger dispensers require that the palm or hand of the user be opened to receive the soap. However, when the hands of the user are placed under the faucet to obtain water, some portion of the soap is washed off and wasted. Even with the plunger being centered within an inverted dispenser, some of the soap being dispensed can and does end up on the sink or floor.

The present invention is directed to integrating a soap dispenser into another otherwise conventional water-dispensing faucet. By timing and sequencing the delivery of water and the delivery of soap, a cleaner and more efficient means of washing one's hands is provided. By integrating the soap dispensing function into the faucet, a separately mounted dispenser is not required and the associated mess on the sink and/or on the floor is avoided.

The fact that both water and soap are dispensed from the same faucet, combined with the ability to electronically time and sequence both deliveries, means that the sequence and the duration of each delivery interval can be varied to suit a particular need or usage. For example, an initial delivery of water to wet the hands, followed by soap, followed by rinse water would be one possibility. Another option is to permit a second quantity of foam soap to be delivered prior to rinsing. The time duration to wet the hands is minimal while the delay after soap delivery would be longer to provide time to scrub one's hands. The rinse cycle would be adjustable as well.

In addition to integrating the soap dispenser into a water faucet, the present invention is designed to dispense the soap as a foam product. In order to generate a foam consistency for the soap, a liquid soap is mixed with air and pushed through a fine mesh. Considering the normal size of the pump and plunger mechanisms for conventional foamers, such as those for health and beauty aid products, the packaging of the present invention into a faucet, without otherwise altering the exterior size of the faucet, becomes a novel and unobvious aspect of the present invention.

As will be described herein, the initial construction and arrangement of the present invention was conceived in terms of modifying an existing conventional water-dispensing faucet. The important functional blocks, components, and subassemblies are generally described herein as if they are to be added to a modified faucet. However, it should be understood that large scale production of the present invention would likely integrate many of the required functional blocks, components, and subassemblies directly into the faucet. For example, a separate foam mixing chamber that is assembled into the existing faucet could be replaced by a corresponding cavity that is cast and/or machined directly into the faucet body. Regardless of the selected construction style and options as described herein, the soap conduit should be fabricated out of a suitable plastic to avoid corrosion issues.

The generation of soap foam also requires attention to keeping the dispensing tip clear so that it does not clog or dry out if there is an extended period of non-use. This need is also addressed by the present invention. If concerns arise regarding the foam soap being dispensed through the aerator disclosed herein, an opening in the envelope behind the aerator is contemplated.

BRIEF SUMMARY

A foam-dispensing faucet for dispensing a quantity of foam soap and separately dispensing a flow of water according to one embodiment of the present invention includes a faucet body having a dispensing opening, water supply means integrated into the faucet body for delivering water to the foam-dispensing faucet, liquid soap means integrated into the faucet body for delivering liquid soap to the foam-dispensing faucet, air supply means integrated into the faucet body for delivering air to the foam-dispensing faucet, the interior of the faucet body being configured for processing liquid soap from the liquid soap means and air from the air supply means into a foam soap, and control means for timing and sequencing the dispensing of water and foam soap from the foam-dispensing faucet.

One object of the present disclosure is to describe an improved structure and method for dispensing liquid soap.

DETAILED DESCRIPTION

Figure 1:
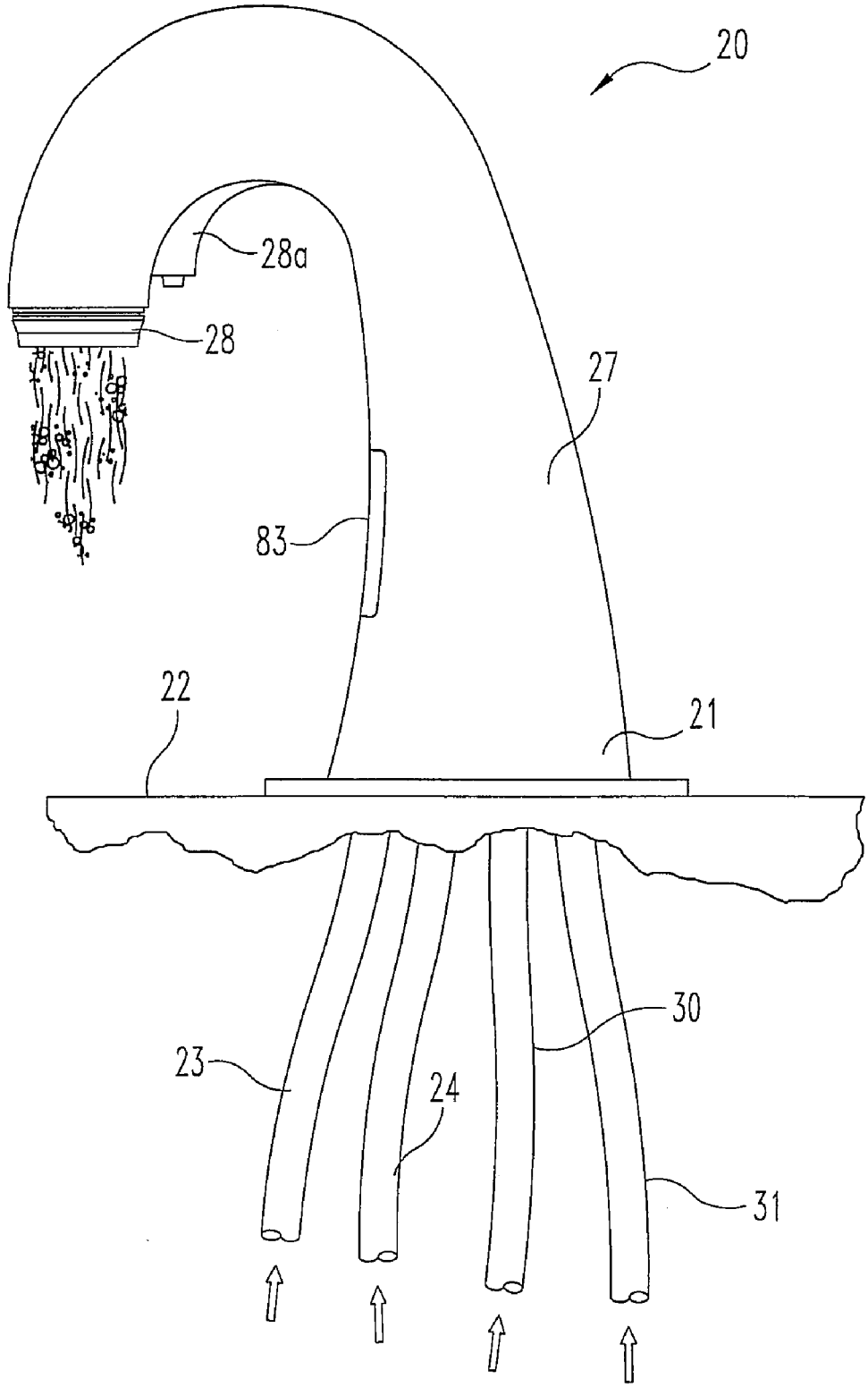
FIG. 1 is a side elevational view of a foam-dispensing faucet according to one representative embodiment of the present invention.

For the purposes of promoting an understanding of the disclosure, reference will now be made to the embodiments illustrated in the drawings and specific language will be used to describe the same. It will nevertheless be understood that no limitation of the scope of the disclosure is thereby intended, such alterations and further modifications in the illustrated device and its use, and such further applications of the principles of the disclosure as illustrated therein being contemplated as would normally occur to one skilled in the art to which the disclosure relates.

With reference to FIGS. 1-5, the details of the present invention are illustrated. The dispensing faucet 20 is constructed and arranged to separately dispense water and soap with a foam consistency. As will be described herein, the present invention in the form of faucet 20 integrates a soap dispenser into an otherwise conventional water-dispensing faucet. This integration provides a desirable efficiency, cleanliness and cost savings in terms of the soap that is not wasted and the mess that is not created. In terms of cleanliness, the sink area and the floor beneath the dispenser are kept cleaner compared to having a separate, remote dispenser of liquid soap. Additionally, the hygiene of the users is improved by the non-contact aspects of the present invention. With appropriate proximity sensing, the initial water interval for wetting the hands occurs without any contact between the user and the faucet. The same is true for the dispensing of the foam soap and the delivery of the rinse water. By electrically or electronically timing the event durations and the sequence of events, including shut off, the user never has to touch any portion of the dispensing faucet, including the soap dispensing portions, nor any portion of the sink.

With continued reference to FIG. 1, faucet 20 is intended to represent a normally-sized, conventionally-shaped, water-dispensing faucet of the type that might be found in a public restroom, a corporate or industrial setting, a residence, or similar facility. The base 21 is mounted or connected to a sink surface 22 or similar countertop surface, with the requisite flow lines and supply lines running into the faucet coming in from beneath the sink or cabinet. For example, from beneath the sink or from within any below-sink cabinet that might be present, hot water line 23 and cold water line 24 run from supply lines into faucet 20. As will be described, these two lines can be arranged as a single line, downstream from a mixer valve. Typically, either separate control valves or a fluid control valve are used to allow the selection of hot and cold water ratios for the desired resultant temperature. Also included as part of FIG. 1 are incoming lines 30 for air and 31 for soap. Adjacent to flow outlet 28 is an alternate dispensing outlet 28*a*.

Figure 1A:
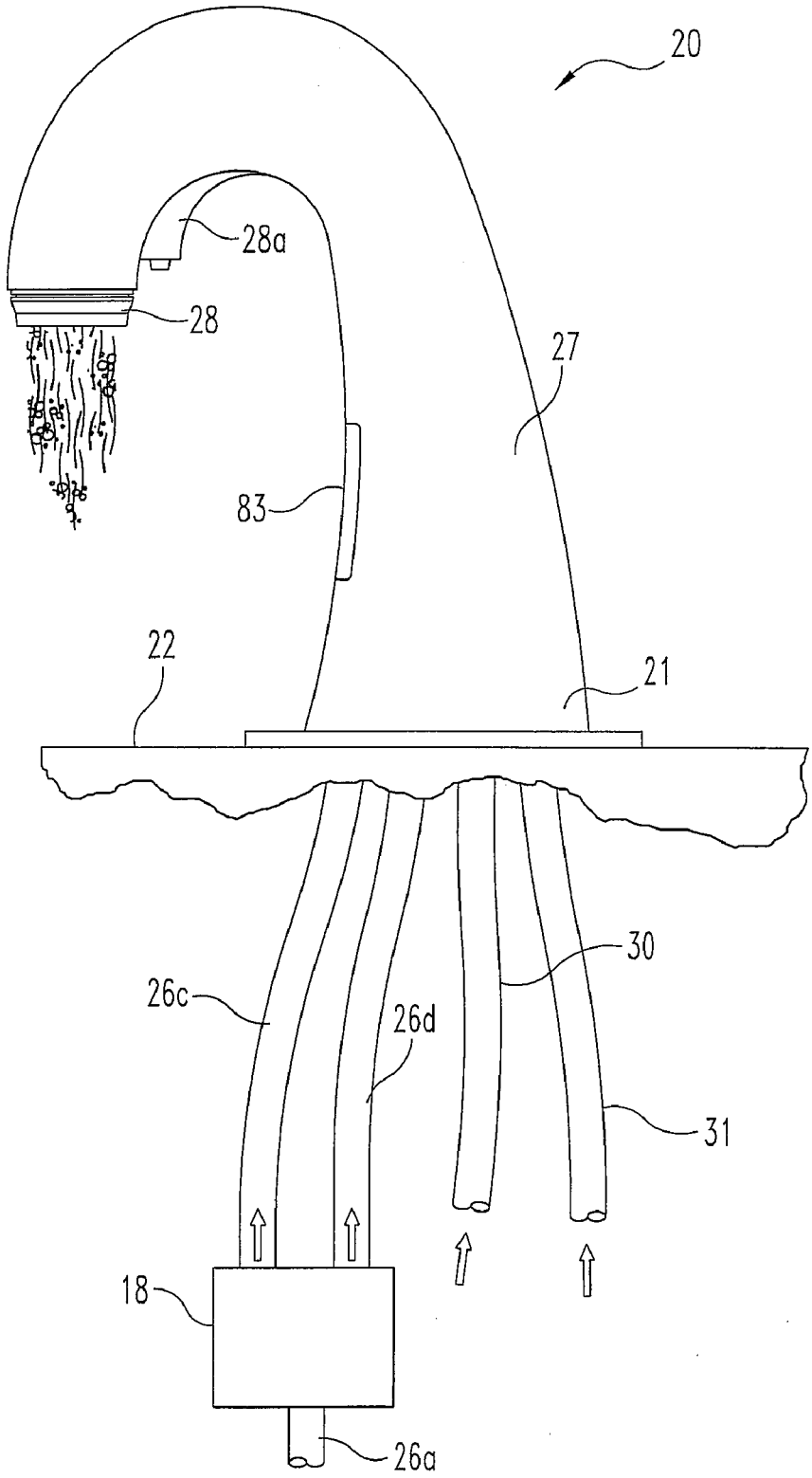
FIG. 1A is a side elevational view of a foam-dispensing faucet according to a preferred embodiment of the present invention.
Figure 5:
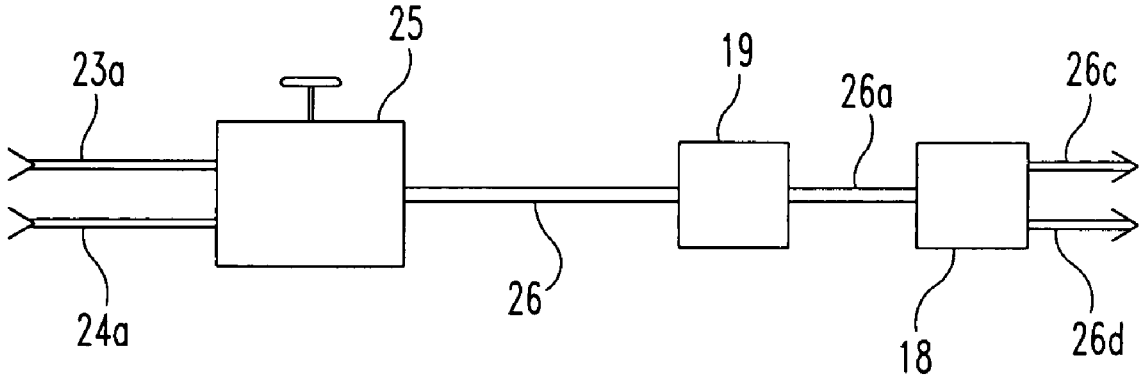
FIG. 5 is a diagrammatic illustration of one flow path arrangement according to an embodiment of the present invention.

Considering FIGS. 1, 1A, and 5, the arrangement of the water lines is influenced by the size and available space within faucet 20. In FIG. 1, water lines 23 and 24 are run into the faucet body and any mixing and valve control occurs internally. A more likely arrangement is based on what is illustrated in FIG. 5 and the FIG. 5 arrangement corresponds to FIG. 1A. As illustrated, while the two water lines 26*c* and 26*d* contain basically the same blend or mix of hot and cold water, having the two lines is a preferred arrangement to that of having a single, larger diameter line as explained herein. As noted, this decision of two equivalent water lines or a single larger line depends in part on the specific faucet that is selected or available and, as noted herein, is based on the specific faucet that was selected to evaluate and test the disclosed structure.

When a non-contact design is desired, such as for the present invention, the mix ratio for the hot and cold water should preferably be determined in some fashion, upstream from the faucet. As one option, this task can be performed by a fluid control valve, either placed inside the faucet 20 or positioned nearby. Another option is to simply control the flow volume of hot and cold water into the two lines and allow these to mix just prior to dispensing the water from the faucet outlet (nozzle). Further design options and alternatives are contemplated as would be well-known in the water-dispensing art for determining and generating a desired water temperature to be dispensed from a faucet. For example, the ratio of hot and cold water for the mixed combination can be set or predetermined at a remote water-control site with separate hot and cold water manual valves or a mixer valve. If this option is used, then a single water line runs into the faucet. Then, whenever water is called for, the main water line located inside the faucet receives the mixer valve water at the predetermined, desired temperature. As would be understood, two water lines run into the mixer valve and one water line runs from the mixer valve. It is therefore the location of the mixer valve that impacts the number and location of water lines in the faucet 20, see FIG. 5. For example, and as diagrammatically illustrated in FIG. 5, the present invention contemplates running two water lines 23*a* and 24*a*, one for hot water and the other for cold water, into a mixing valve 25 or chamber upstream from the faucet outlet. A single water 26 line runs from the mixing valve 25 to a water solenoid valve 19 that controls the water flow to the faucet outlet. The solenoid operated water valve connects via line 26*a* to a manifold block 18. Two lines 26*c* and 26*d* connect to the faucet.

In the course of modifying an existing, conventional faucet in order to evaluate and test the disclosed structure, it was decided that a single ⅜ inch water line, used to deliver mixer valve water at the desired temperature, was too large in view of the foamer components to be positioned in the faucet adjacent the faucet outlet 28. This single ⅜ inch water line was exchanged for two separate ¼ inch water lines, so as to maintain the same water volume. These are shown as incoming water lines 26*c* and 26*d* in FIG. 1A. In production, it is anticipated that the interior of the faucet can be shaped and configured to receive all of the necessary components for the integrated liquid soap foamer and still have space for a single ⅜ inch mixed water line.

The body 27 of faucet 20 extends from base 21 to faucet outlet 28. Located within faucet body 27 are four incoming lines and two (or three) delivery lines. As already discussed, two of the incoming lines are ¼ inch lines that replace one ⅜ inch line. The third incoming line is for liquid soap and the fourth incoming line is for air to mix with the liquid soap in order to create a foam consistency for the dispensed soap. As for the two (or three) delivery lines, one delivers a coarse foam soap from the mixing chamber and the other one (or two) delivers water at the desired temperature. If space within the faucet envelope permits, a single water delivery line can be used. If space within the faucet envelope is not adequate, two separate water lines are to be used.

Figure 2:
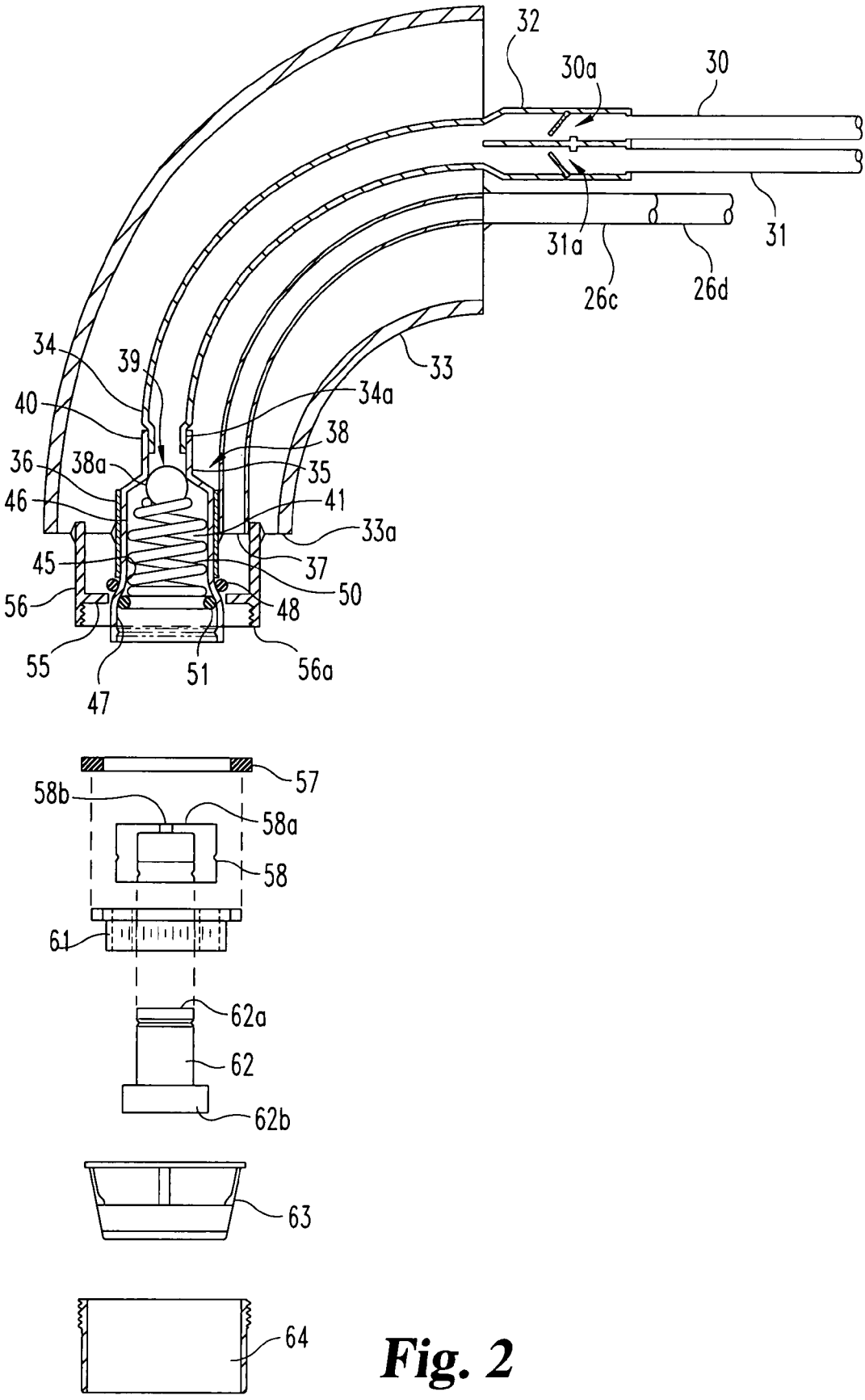
FIG. 2 is an exploded, side elevational view, in partial section, of the FIG. 1 foam-dispensing faucet.

With reference to FIGS. 1, 1A, and 2, the air and liquid soap lines 30 and 31, respectively, are connected to a mixing chamber 32. When modifying an existing faucet, a brass block 33 was machined to create the desired conduit enclosure for the plastic mixing chamber 32 and the two lines 26*c* and 26*d* are soldered to the brass block 33 in order to establish the secure and leak-free water connection. It is contemplated that production units will provide for this mixing chamber to be integrated directly into the faucet envelope, upstream from outlet 28. Each line 30 and 31 is fitted with a check valve 30*a* and 31*a*, respectively. The check valve 31*a* for the liquid soap line prevents any back or reverse flow of the liquid soap. The check valve 30*a* for the air line prevents the reverse flow of air, but more importantly, by placing this check valve at the line inlet to the mixing chamber, liquid soap cannot flow (reverse) into the air line 30. When the air and soap solenoid valves were energized, a dose of soap was quickly deposited into the mixing chamber. The air continues to blow through the mixing chamber, the coarse foam conduit and check valve 38, until the timer times out. This purging action removes the coarse foam that is downstream of check valve 31*a* and produces fine foam at faucet outlet 56.

Regardless of the specific mechanical configuration selected, the functional aspects are the same. The air and liquid soap are mixed so as to create a soap product that can best be described as having a coarse foam consistency. The delivery line 34 that exits from the mixing chamber includes a tapered tubular fitting 34*a* for a pressure-fit connection into a downstream fitting 35 that is received by a copper sleeve 36 that is soldered into brass block 33. Fitting 35 has a sliding fit into copper sleeve 36 and includes a spring-biased ball check valve 38 that is created by the seating of ball 38*a* against opening 39. As such, this fitting 35 can be functionally described as a check valve housing. Inlet tube 40 communicates with the interior 41 of fitting 35 and receives tubular fitting 34*a*.

Fitting 35 is shouldered at the transition 45 from the smaller diameter wall 46 to the larger diameter wall 47. An O-ring 48 is positioned at the shouldered transition 45 for compression against the surface of the transition 45. The interior of fitting 35 includes, in addition to ball 38*a*, spring 50 and O-ring 51. When the two water lines 26*c* and 26*d* are used, they are soldered into position and into fluid connection with brass block 33, see FIG. 2. A passageway or conduit connects the flow from one of the two lines 26*c* and 26*d* to drilled outlet 37 on one side of sleeve 36. A second passageway or conduit connects the other flow line to an outlet (not illustrated) on the opposite side of sleeve 36.

At this point in the description of the present invention, we have water lines positioned within the faucet envelope for the delivery of the desired mix ratio of hot water and cold water. We also have an air line and a liquid soap line leading into a mixing chamber for generating a coarse foam soap product. The tubular fitting 34*a* is inserted into (or onto) inlet tube 40. The remainder of the components that are required to complete the faucet assembly are illustrated in FIG. 2 and described as follows.

Brass block 33 represents the dispensing end of a faucet with a sleeve 56 soldered into block 33 adjacent end 33*a*. Sleeve 56 includes an annular shelf 55 and is internally threaded between lower edge 56*a* and shelf 55. The arrangement of annular gasket 57 relative to wall 47 allows water to pass between the inside diameter of gasket 57 and the outside diameter of wall 47. Annular gasket 57 also fits up against the lower surface of shelf 55. Expansion chamber 58 has a generally cylindrical shape and causes additional foaming as the coarse foam passes through the smaller orifice 58*b* and into expansion chamber 58. Also, expansion chamber 58 fits up into the cylindrical open interior defined by wall 47. The upper surface 58*a* applies pressure against O-ring 51 and against one end of spring 50. The opposite end of spring 50 contacts ball 38*a*. The dimensional sizes and relationships cause the spring 50 to be compressed so as to continuously spring bias the ball 38*a* up against opening 39 so as to close opening 39 as part of the expected ball valve 38 operation.

The next component in the assembly is the aerator 61, followed by a screen housing 62 including on its interior a fine mesh screen (not illustrated) adjacent end 62*a* and a very fine mesh screen (not illustrated) adjacent end 62*b*. As will be described in greater detail, the coarse foam via tubular fitting 34*a* that connects to tube 40 applies pressure to ball 38*a*, causing the ball to move away from opening 39. This permits the coarse foam soap to flow through the assembly of parts into screen housing 62. The coarse foam bubble size is forced through the fine mesh screen, changing the foam consistency. The smaller foam bubbles are then forced through the very fine mesh screen, producing a desirable foam consistency that is suitable for use in conjunction with faucet 20.

The next component in the assembly stack, as illustrated in FIG. 2, is the aerator screen 63, followed by the aerator housing 64. Aerator housing 64 is externally threaded so as to thread into the sleeve 56. The aerator housing 64 captures the aerator screen 63 and, upon full threaded engagement, securely holds all of the component parts into position. As the full threaded engagement between the aerator housing 64 and sleeve 56 is being achieved, the screen housing 62 passes through aerator 61 and snaps into the expansion chamber 58. The expansion chamber then snaps into the fitting 35 (i.e., check valve housing), applying the pressure to the end of spring 50 and, in turn, spring-biasing ball 38*a*.

Functionally, the annular gasket 57 provides a leak-free combination such that water flows through the inside diameter of gasket 57, but water is not allowed to bypass its intended flow path. The O-ring 48 prevents the flow of water back up into the faucet envelope 27 by passage between fitting 35 and the ½ inch copper sleeve 36. As noted, the water flows into the area of the O-ring 48 on opposite sides of sleeve 36. The water passing through sleeve 56 flows into the aerator 61 and out through the aerator screen 63. The check valve arrangement of spring-biased ball 38*a* and opening 39 prevents the dripping of condensed foam between washing/dispensing cycles. The air supply is on after the liquid soap has become foam and blows the coarse foam out of the conduit and the components below check valve 31*a*. The water that comes out of openings 37 and 37*a* flows around the screen housing 62, creating a small vacuum which sucks out any remaining foam as well as flushing the very fine screen 62*b* clean. The coarse foam first passes into the expansion chamber 58 and, from there, into the screen housing 62, reducing the bubble size.

The sequence of operation for faucet 20, assuming that non-contact operation is intended, begins or is initiated by a sensor mounted in or adjacent to the faucet when the sensor detects a person's hands when they are placed under the faucet outlet. A water valve is momentarily energized and a small quantity of water is dispensed to wet the hands of the user. A liquid soap and compressed air solenoid are energized which directs both liquid soap and the air through a conduit to a mixing chamber. The foaming action starts in the mixing chamber and, after several steps, foam soap is dispensed from the faucet outlet into the person's hands. After receiving a quantity of soap, it is expected that the user will stand more upright while washing their hands. There is sufficient moisture in foam soap to wash the hands without adding additional water. After an adjustable time delay, the water solenoid is energized and water flows from the mixer valve to the faucet. While rinsing the foam soap off, suppose the user senses that the hands are not clean. If this is the case, then the user places the hands under the faucet and the soap dispensing cycle is repeated.

Figure 3:
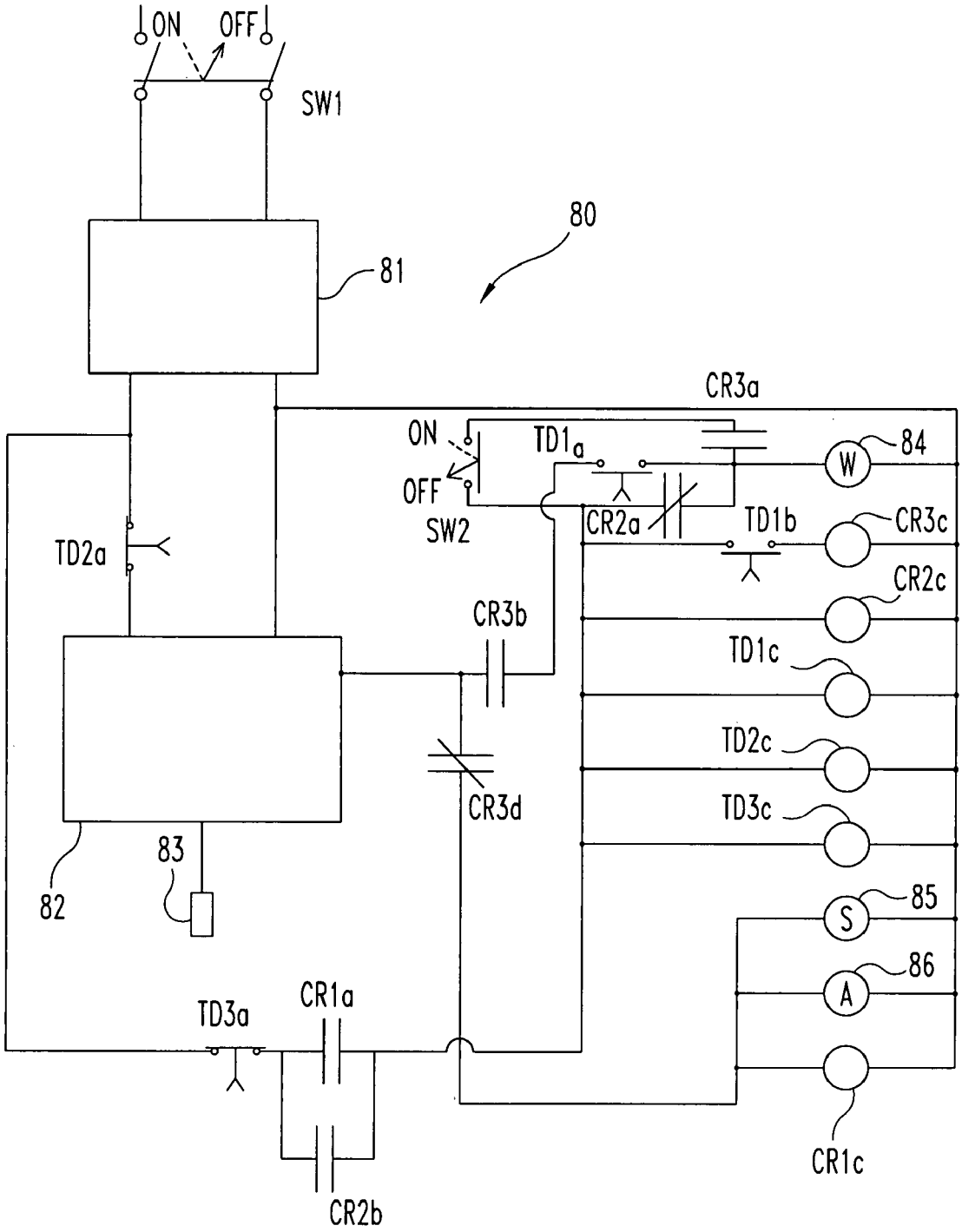
FIG. 3 is a schematic diagram of the control circuitry associated with the FIG. 1 foam-dispensing faucet.

Referring to FIG. 3, the control circuitry 80 associated with the intended sequence of operation of faucet 20 is illustrated. Control circuitry 80 includes a 24 volt (a.c.) transformer 81, a control module 82 that is offered by Sloan Valve Company of Franklin Park, Ill., and a sensor 83. The remaining components include control relays (CR), time delay relays (TD), solenoids for controlling the delivery of water (W) 84, soap (S) 85, and air (A) 86, and ON OFF switches SW1 and SW2. Each control relay CR1-CR3 includes a coil and one or more contacts that are either normally open or normally closed. Each time delay relay TD1-TD3 includes a coil and a contact that is either timing open or timing closed. Each coil is represented by a circle in the FIG. 3 schematic. When the control relay (CR) includes multiple contacts, suffixes "a", "b", etc. are used to identify and differentiate. The "c" suffix is used to identify the coil portion of each control relay. The same system is used for identifying and differentiating the time delay relays.

The sequence of operation for faucet 20, assuming that non-contact operation is intended, begins or is initiated by a sensor 83 mounted in or adjacent to the faucet 20 detecting a person's hands when they are placed under the faucet outlet. When the sensor 83 is tripped, the control module 82 provides a 24 volt output for approximate 6 seconds. Control relay coil CR1*c*, solenoid valve A and solenoid valve S are energized through the normally-closed relay CR3*d*. The normally-closed contact CR2*a* energizes solenoid 84 momentarily, providing a small amount of water in order to wet the hands of the user. Energizing the CR2*c* coil shuts off the water and locks in around CR1*a* through TD3*a*. The three relay coils TD1*c*, TD2*c*, and TD3*c* were energized at that time and started timing. Energizing solenoids 85 and 86 directs both liquid soap and air through a conduit to a mixing chamber. The foaming action starts in the mixing chamber and, after several steps, foam soap is dispensed from the faucet outlet into the user's hands. After receiving a quantity of soap, it is expected that the user will stand more upright while washing their hands. There is sufficient moisture in foam soap to wash the hands without adding additional water. However, if the user desires additional foam soap, the hands are placed under the faucet outlet again and a second quantity of foam soap is dispensed, providing that TD1*b* has not timed closed and energized the CR3*c* coil. When the CR3*c* coil is energized, the 6 second 24 volt signal from the control module 82 is directed to the water solenoid valve 84 through the second contact of TD1*a* which timed closed when the CR3*c* coil was energized, starting a six (6) second water flow. Placing the hands under the faucet a second time trips the control module 82 timer again and allows 6 seconds of additional water flow, providing that TD2*a* has not timed open, shutting off the control module 82. TD3*a* is the total cycle timer and times open immediately after TD2*a*, shutting down the rest of the system.

The sequence of operation is determined by the adjustable time delay relays (TD) and the timer portion of the control module 82. The timers can be adjusted to deliver one or two doses of soap and turn the water on once for an extended time or on twice for 6 seconds each time. In order to turn the water on once for an extended period of time, the normally-open contact TD1*a* ahead of solenoid 84 is by-passed by turning SW2 to the on position because CR3*a* was closed when CR3*c* was energized. Water valve 84 is now energized through TD3*a*, CR2*b*, SW2 and CR3*a*. The water flow starts when the CR3*c* coil is energized, closing contact CR3*b*, CR3*a* and with SW2 in the on position, water flow continues until TD3*a* times open, ending the cycle. One design variable or option is to change the timer 82 to 3 seconds, and this is felt to be long enough in order to dispense soap. At 3 seconds, the water comes on three or four times. Also, by putting a switch in series with CR3*a*, either a continuous long flow or 3 seconds of flow or 6 seconds of flow are possible without a wiring change. If the switch is in the on position, water flows when CR3*a* closes and stays on until TD3*a* times open.

In order to provide the liquid soap that is dosed for each use, a reservoir or supply is required. Preferably, this liquid soap supply is placed in a remote location beneath the sink or in some type of secure container with limited access. A dosing pump of some type is also required to deliver a dose of liquid soap from the supply to the mixing chamber 32. It is envisioned for the present invention that the pump will be operable by air pressure. It is also intended as part of the present invention that the stroke and discharge volume of the pump are adjustable.

Figure 4:
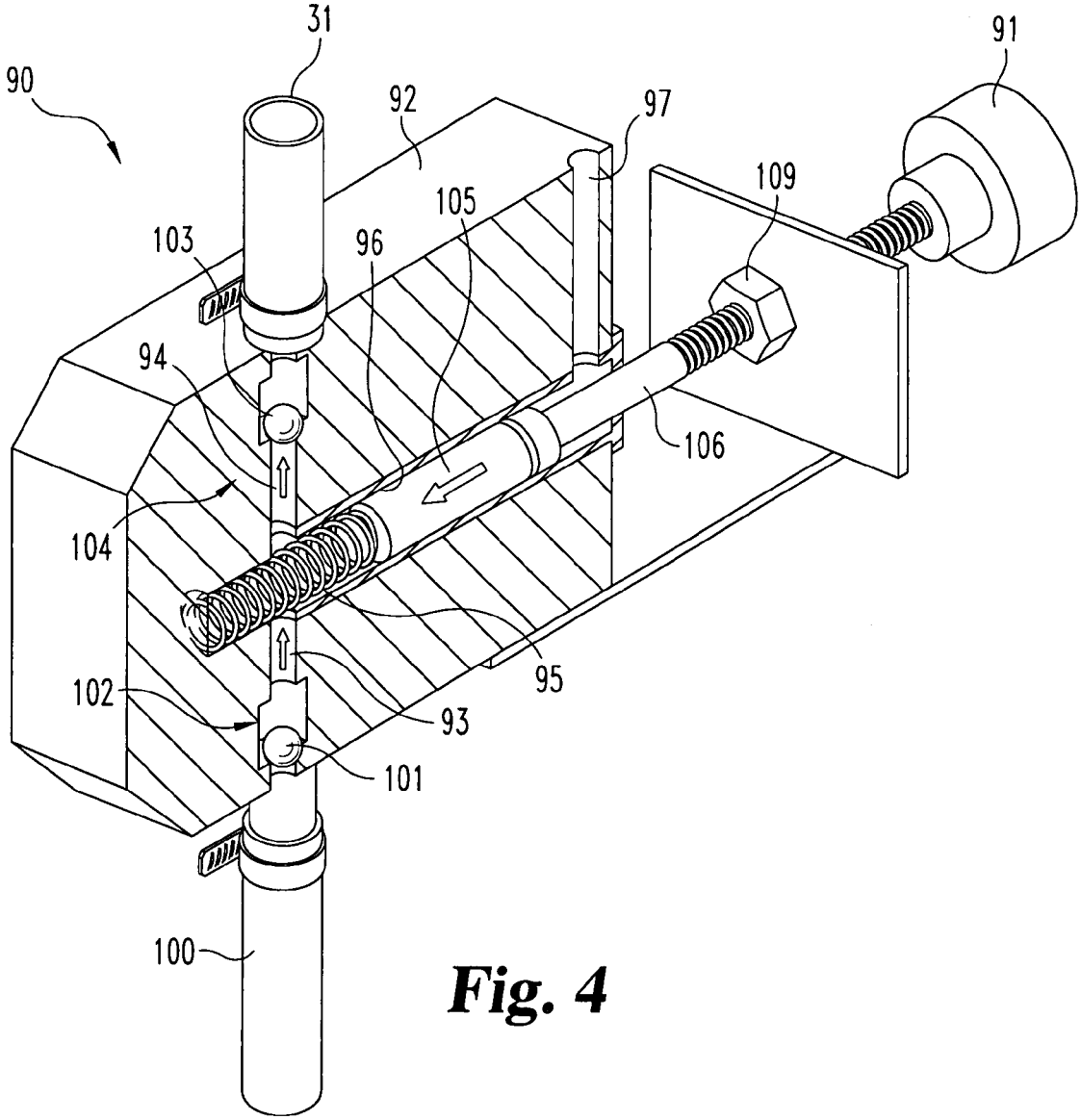
FIG. 4 is a perspective view, in partial section, of a liquid soap dispensing pump associated with the FIG. 1 foam dispensing faucet.

A suitable dosing pump 90 for use with the present invention is illustrated in FIG. 4. Pump 90 is air pressure operated when in the automatic sequence mode. The pump 90 is manually operable by way of hand pump knob 91 to adjust the discharge volume and/or to purge the system of trapped air. The pump 90 structure includes a machined block 92 having a soap inlet passageway 93, a soap outlet (dispensing) passageway 94, an intersecting passageway 95 that is connected with and in flow communication with discharge chamber 96, and an air inlet 97.

A liquid soap line 100 leading from a liquid soap storage tank (not illustrated) is connected into the soap inlet passageway 93. The machined shape of this inlet passageway, in cooperation with ball 101, creates a check valve 102. Similarly, the liquid soap line 31 leading to mixing chamber 32 is connected into the soap outlet passageway 94 The machined shape of this outlet passageway, in cooperation with ball 103, creates a check valve 104. The two check valves 102 and 104 operate in opposed directions. The discharge chamber receives a spring-biased plunger 105 that is part of rod 106 that is connected to knob 91. This illustrated and cooperative structure means that, once the pump is charged with a quantity of liquid soap, a forward stroke of the plunger 105 pushes liquid soap out through soap line 31 and, at the same time, closes check valve 102 so that the charge of liquid soap does not return to the storage tank. The return or back stroke of plunger 105 creates a sufficient suction to close check valve 104 and draw another charge (dose) of liquid soap from the storage tank by way of the open check valve 102. Air from a normally closed three-way solenoid (not illustrated) is coupled to the air inlet 97 and is used to create the forward stroke of the plunger when in the automatic mode.

If the automatic mode of operation is not intended or desired, the manual, inward pushing on knob 91 creates the same effect or result as the use of air pressure. Hex nut 109 is used to set the stroke length for plunger 105, whether operating in the automatic mode or the manual mode.

While the preferred embodiment of the invention has been illustrated and described in the drawings and foregoing description, the same is to be considered as illustrative and not restrictive in character, it being understood that all changes and modifications that come within the spirit of the invention are desired to be protected.

The invention claimed is:

1. A foam-dispensing faucet for dispensing a quantity of foam soap and separately dispensing a flow of water from the same faucet outlet, said foam-dispensing faucet comprising:

a faucet body defining a dispensing outlet;

water supply means integrated into said faucet body for delivering water to said foam-dispensing faucet;

liquid soap means integrated into said faucet body for delivering liquid soap to said foam-dispensing faucet;

air supply means integrated into said faucet body for delivering air to said foam-dispensing faucet;

foam producing means integrated into said faucet body for processing liquid soap from said liquid soap means and air from said air supply means into a foam soap; and control means for timing and sequencing the separate dispensing of water and foam soap from said dispensing outlet.

2. A method comprising the steps of:

initiating a single sensor connected to control circuitry;

dispensing a predetermined amount of water from a faucet having a faucet outlet;

creating foam soap by mixing a predetermined amount of liquid soap and air within the body of said faucet;

dispensing said foam soap from said faucet outlet; and dispensing a predetermined amount of water from said faucet outlet.

3. The method of claim 2 further comprising:

forcing said foam soap through a mesh screen.

4. The method of claim 3 further comprising:

creating a vacuum beneath said mesh screen by the flowing of water around said mesh screen.

5. A foam soap and water faucet, comprising:

a faucet body including a dispensing opening, at least one water line integrated into said faucet body, at least one liquid soap line integrated into said faucet body, at least one air line integrated into said faucet body, and a mixing chamber having an input end and output end, said input end coupled to said air line and said liquid soap line, said output end coupled to a foam check valve housing;

a foam screen assembly including at least one mesh screen, said foam screen assembly coupled to said foam check valve housing; and a control sensor operationally connected to control circuitry constructed and arranged to control timing and the amount of water or foam soap to exit said dispensing opening, said sensor being positioned proximate to said faucet body.

6. The foam soap and water faucet of claim 5, further comprising:

an aerator assembly including an aerator screen and aerator housing, said aerator screen being positioned within said aerator housing, said aerator housing being fixedly attached to said faucet body and concentrically positioned around said foam screen assembly.

7. The foam soap and water faucet of claim 5, further comprising:

a foam check valve assembly including a valve spring, a spring-biased ball, and said foam check valve housing, said foam check valve housing having a fitted end, said spring and spring-biased ball positioned within said check valve housing, said spring-biased ball being seatedly disposed against said fitted end.

* * * * *